US008804464B2

(12) United States Patent
Hielscher et al.

(10) Patent No.: US 8,804,464 B2
(45) Date of Patent: Aug. 12, 2014

(54) DEVICE FOR GENERATING RADIAL ULTRASOUND OSCILLATIONS

(71) Applicant: Dr. Hielscher GmbH, Teltow (DE)

(72) Inventors: Harald Hielscher, Stahnsdorf (DE); Thomas Hielscher, Stahnsdorf (DE); Holger Hielscher, Teltow (DE)

(73) Assignee: Dr. Hielscher GmbH, Teltow (DE)

( * ) Notice: Subject to any disclaimer, the term of this patent is extended or adjusted under 35 U.S.C. 154(b) by 0 days.

(21) Appl. No.: 13/656,795

(22) Filed: Oct. 22, 2012

(65) Prior Publication Data

US 2014/0112106 A1 Apr. 24, 2014

Related U.S. Application Data

(60) Provisional application No. 61/549,383, filed on Oct. 20, 2011.

(51) Int. Cl.
*B06B 1/02* (2006.01)

(52) U.S. Cl.
USPC ..... 367/189

(58) Field of Classification Search
CPC ..... B06B 3/02; B06B 3/00; B06B 1/02; B06B 1/0633
USPC ..... 367/189
See application file for complete search history.

(56) References Cited

U.S. PATENT DOCUMENTS

| | | | | |
|---|---|---|---|---|
| 5,200,666 | A * | 4/1993 | Walter et al. | 310/325 |
| 5,653,346 | A * | 8/1997 | Frei et al. | 310/325 |
| 5,994,818 | A * | 11/1999 | Abramov et al. | 310/325 |
| 2011/0042014 | A1 * | 2/2011 | Vogler | 156/580.1 |

FOREIGN PATENT DOCUMENTS

| | | | | |
|---|---|---|---|---|
| DE | 102012110033 | * | 4/2013 | B06B 3/00 |

* cited by examiner

*Primary Examiner* — Daniel Pihulic

(57) ABSTRACT

The invention is directed to a device for generating ultrasound oscillations. In order to be able to excite with the device oscillations in a vessel simultaneously and uniformly from several sides, the device includes a resonator which oscillates radially in several directions during operation of the device.

13 Claims, 6 Drawing Sheets

DEVICE FOR GENERATING RADIAL ULTRASOUND OSCILLATIONS

RELATED APPLICATION

This application claims the benefit of priority under 35 USC §119(e) of U.S. Provisional Patent Application No. 61/549,383 filed Oct. 20, 2011, the contents of which are incorporated herein by reference in their entirety.

BACKGROUND OF THE INVENTION

The present invention relates to a device for generating ultrasound oscillations, with an ultrasound generator and a resonator connected to the ultrasound generator for conducting ultrasound. The resonator is configured to oscillate longitudinally during operation of the ultrasound generator.

Devices for generating ultrasound oscillations are known and are used, for example, to produce low-frequency high-power ultrasound. Low frequency high-power ultrasound refers to ultrasound with a working frequency of 15 to 100 kHz, preferably 15 to 60 kHz and, for example, 30 kHz and acoustic power above 5 W, preferably 10 W to 1,000 W and, for example, 200 W. For example, piezoelectric or magnetostrictive systems can be used to generate the ultrasound. Low-frequency high-power ultrasound finds ubiquitous applications in the treatment of fluids, such as food, cosmetics, and dyes, as well as nanomaterials. For this purpose, ultrasound having amplitudes of 1 to 350 μm, preferably 5 to 50 μm and for example 15 μm is directly or indirectly transferred via a resonator to the materials to be treated.

In addition to the treatment of materials in open vessels, for example a beaker, a dish or channel-shaped vessel, many applications require low-frequency high-power ultrasound to be introduced into closed vessels, such as reactor vessels or pipes. The closed vessels are often closed at least during treatment with ultrasound. Depending on the application, the closed vessel may be under a lower pressure or a higher pressure than ambient pressure. A lower pressure (vacuum) refers to a pressure between vacuum (0 bar absolute) and ambient pressure (e.g., 1 bar absolute), for example at 0.5 bar. A higher pressure (overpressure) refers to a pressure above the ambient pressure. Some vessels are used with an internal vessel pressure of between 1.5 bar absolute and 1000 bar absolute, for example 3 bar absolute. The material to be treated, for example the liquid, may reside inside the vessel or may flow through this vessel.

For introducing low-frequency high-power ultrasound into such vessel, either the vessel wall can be contacted from outside by the low-frequency high-power ultrasound system to excite oscillations, or a low-frequency high-power ultrasound system can be installed at least partially or completely in the pressurized interior space of the vessel. In particular, the ultrasound generator may be located outside of the vessel and the oscillations may be introduced into the interior space of the vessel via one or more resonators. The ultrasound generator may be an ultrasound transducer and, for example, a linear piezoelectric transducer.

However, in particular when transmitting the ultrasound indirectly into the interior of the vessel through the vessel wall, the ultrasound is transmitted inefficiently by the longitudinally oscillating resonator.

It would therefore be desirable and advantageous to obviate prior art shortcomings and to provide an improved device for generating ultrasound oscillations, with which materials contained in vessels can be more efficiently treated with ultrasound.

SUMMARY OF THE INVENTION

According to one aspect of the present invention, a device for generating ultrasound oscillations includes an ultrasound generator, a resonator connected to the ultrasound generator for conducting ultrasound and oscillating longitudinally during operation of the ultrasound generator, and an additional resonator connected to the longitudinally oscillating resonator in an ultrasound transmitting manner and configured to oscillate radially in a plurality of radial directions during the operation of the ultrasound generator.

In this way, the oscillations oriented in radial directions are efficiently transmitted to a vessel wall of the vessel containing the liquid, so that the ultrasound oscillations can be transmitted through the vessel to the liquid contained in the vessel with a low loss.

To introduce low-frequency high-power ultrasound into a vessel from the outside, oscillations may be transferred to the vessel contents via the vessel wall. The oscillations may be transmitted to all sides of the vessel wall by enclosing the entire vessel wall or a part of the vessel wall. This part may, for example, extend at least around sections of the cross-section of the vessel. The oscillations may operate on the vessel wall at different angles, for example, almost or completely vertically on the vessel wall. With a circular or an elliptical cross section, the oscillations may operate radially to the vessel's cross section. For polygonal cross sections, the oscillations may be oriented radially and converge at a point within the vessel's cross section.

The inventive solution may be further improved by various embodiments which each are separately advantageous and which can be combined with each other in any desirable way. These embodiments and the advantages associated with these embodiments will now be described.

According to an advantageous feature of the present invention, the additional resonator may at least partially encircle an opening and may be substantially ring-shaped. The opening is preferably matched to the vessel's cross-section, so that the resonator can at least partially or completely surround the vessel, wherein the resonator has in the region of the opening at least one contact point and preferably at least two contact points with the vessel. At least one of these contact points is preferably located outside the oscillation minimum of the resonator.

According to another advantageous feature of the present invention, the resonator may be ring-shaped, wherein the vessel may then be inserted in the opening, so that the outside of the vessel wall contacts the inside of the resonator. The ultrasound oscillations are then distributed substantially uniformly in a circumferential direction of the vessel and operate on the interior of the vessel from almost all radial directions. When the vessel does not have a ring-shaped cross-section, the additional resonator may be shaped so as to receive a vessel with a different and for example polygonal cross-section, so that the outside of the vessel wall or of several vessel wall sections contact the inside of the additional resonator.

However, if the additional resonator does not completely encircle the opening, the ultrasound oscillation may still be able to be transmitted in radial directions to the vessel, wherein in this situation the ultrasound does not operate on all sides of the vessel.

Advantageously, the additional resonator may be constructed, in particular at least partially, complementary to the outside shape of the vessel wall.

According to another advantageous feature of the present invention, the additional resonator may have several Lambda/2 elements arranged along its circumferential direction, e.g. around the opening of the resonator, whereby the resonator can be produced to readily match the shape of the vessel. Lambda is the wavelength of the ultrasound in the resonator or in the Lambda/2 element obtained from the low-frequency high-power ultrasound frequency and the sound propagation velocity in the resonator. A resonator may be composed of one or more Lambda/2 elements. A resonator consisting of several Lambda/2 elements may be made from a single piece of material of appropriate length. A resonator having several Lambda/2 elements may be assembled from several elements having a length corresponding to an integer multiple of the wavelength, for example, by screwing, welding, gluing or pressing, or maybe made from a single piece of material of appropriate length. Lambda/2 elements may have various material cross-sectional geometries, such as circular, oval or rectangular cross-sections. The cross-sectional geometry and cross-sectional area may vary along a longitudinal axis of one of the Lambda/2 elements. The Lambda/2 elements may be formed, at least on their side facing the opening, straight, round, polygonal or otherwise, and complementary to at least a portion of the opening.

Advantageously, the resonator or its Lambda/2 elements may be made, among others, from metallic or ceramic materials or from glass, in particular from titanium, titanium alloys, steel, steel alloys, aluminum or aluminum alloys, and for example of titanium grade 5.

With the inventive design of the resonator, which at least partially or even completely surrounds the opening and may advantageously be made from a plurality of interconnected Lambda/2 elements, longitudinal oscillations acting on the resonator or on one or more of these Lambda/2 elements can be converted into oscillations that are oriented in a radial or an approximately radial direction, converging to a selected point of the opening and in particular to its center.

Advantageously, the additional resonator may have an even number of Lambda/2 elements.

According to another advantageous feature of the present invention, the opening may be at least partially surrounded by the Lambda/2 elements in a plane, wherein the Lambda/2 elements may adjoin the opening. This allows the Lambda/2 elements to be brought into contact with the vessel that can be arranged inside the opening directly, and in particular on several sides or on all sides perpendicular to a circumferential direction of the opening, for efficient transmission of the ultrasound oscillations to the vessel.

The opening may be centrally located in the additional resonator so that the vessel can not only be placed at the edge of the resonator, which would make handling of the device with the vessel more difficult.

To enable the device to deliver the ultrasound effectively to the vessel, the geometry of the additional resonator may advantageously be matched to the external geometry of the vessel wall. For example, an inner surface of the additional resonator delimits the opening for the vessel in form of an arc, a circle, a curve, a round, jagged, polygonal or star-shaped, when the vessel has a corresponding outer shape.

To excite oscillations in a vessel wall, the additional resonator may not only be configured to receive a vessel, but may alternatively also be inserted into a vessel. To excite oscillations in a vessel wall, the additional resonator may be configured to abut an inner side of the vessel wall, or may be arranged at a uniform distance from the inner side. Advantageously, the additional resonator may be formed at least partially complementary to the inner shape of the vessel and may be shaped, for example on its outer side facing away from the opening, in form of an arc, a circle, a curve, a round, jagged, polygonal or star-shaped.

According to another advantageous feature of the present invention, the additional resonator may include at least one recess for adjustment of a resonant frequency of the additional resonator in the manufacture of the resonator. The at least one recess may be formed as a depression, for example as a blind hole, or as a through-hole. The recess may extend parallel or perpendicular to the central opening and/or to the predominant oscillation direction in the region of the recess and may open parallel to the central opening, or toward the central opening or away from the central opening.

The additional resonator may have several recesses, which may all be constructed identically or differently. By constructing the recesses differently, the oscillation characteristics of the resonator can be changed locally. In this way, for example, local deviations from a desired oscillation characteristic may be changed, adjusted or corrected.

The at least one recess may be formed, for example, as a borehole, a milled pattern or as a slot.

According to another advantageous feature of the present invention, at least one of the Lambda/2 elements may include the at least one recess. With the recess, the oscillation characteristics of the Lambda/2 element may be adapted to a desired oscillation characteristic and/or to the oscillation characteristics of other Lambda/2 elements of the additional resonator. The oscillation characteristics of the additional resonator may be adapted by the at least one recess, for example, to the oscillation characteristics of the longitudinally oscillating resonator.

For example, the resonance frequency/frequencies of the resonator or of the Lambda/2 elements and their amplitude distribution along the opening depend, among others, on the geometry of the opening. The resonance frequency or resonance frequencies of the additional resonator and its/their oscillation amplitude distribution along the opening may be affected by the recesses in the additional resonator or in at least one of its Lambda/2 elements. It is thus possible to influence certain resonant frequencies and/or amplitude distributions by way of the number, size and shape of the recesses in order to match, for example, the resonant frequency of the additional resonator to a resonance frequency of the longitudinally oscillating resonator and/or to approximate or match their excitation frequencies. Furthermore, resonance frequencies of unwanted oscillation patterns may be reduced with the recesses, thereby preventing excitation of unwanted oscillation patterns.

Key aspects of the invention will now be summarized:

A device for transforming longitudinal oscillations into oscillations directed in the radially or approximately radially toward the center of the at least one opening is described. The device has an additional resonator which has, and more particularly consists of, an integer number of Lambda/2 elements, and an opening. At least one of the Lambda/2 elements has at least one recess, for example, an opening, a borehole, a depression or a slot, which is capable of affecting at least one of the resonance frequencies of the resonator and/or the amplitude distribution along the opening.

The additional resonator may have, and especially may consist of, an even number of Lambda/2 elements.

The additional resonator may or may not completely surround the opening.

The additional resonator and the opening may be arranged concentrically.

The opening may have a circular or polygonal shape.

Each of the Lambda/2 elements may have at least one recess, for example, an opening, a borehole, a depression or a slot, wherein the at least one recess is configured to affect at least one of the resonance frequencies of the additional resonator or an amplitude distribution along the opening.

At least one of the resonance frequencies of the additional resonator located in the range 10-100 kHz may be altered with the at least one recess by at least 500 Hz. Alternatively, at least one of the resonance frequencies of the additional resonator located in the range of 15 to 80 kHz may be altered with the at least one recess by at least 2 kHz.

The additional resonator may have a plurality of openings and may be made from a steel alloy, an aluminum alloy, a titanium alloy, a ceramic material and/or glass.

The additional resonator may be configured for transmission of ultrasound having a frequency between 15 and 40 kHz, preferably between 16 and 22 kHz, and having a power between 50 and 20,000 watts, preferably between 10 and 1000 watts.

The maximum diagonal or the diameter of the opening of the additional resonator may measure between 1 and 100 mm.

The maximum amplitude of the oscillations in the radial direction may be greater than 1 μm and smaller than 20 μm, advantageously greater than 5 μm (peak-to-peak value).

The opening may be formed so as to at least partially form-fittingly abut a vessel wall.

At least one of the recesses, for example openings, boreholes, indentations or slots, may be formed so as to at least partially and preferably form-fittingly abut a vessel wall.

BRIEF DESCRIPTION OF THE DRAWINGS

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
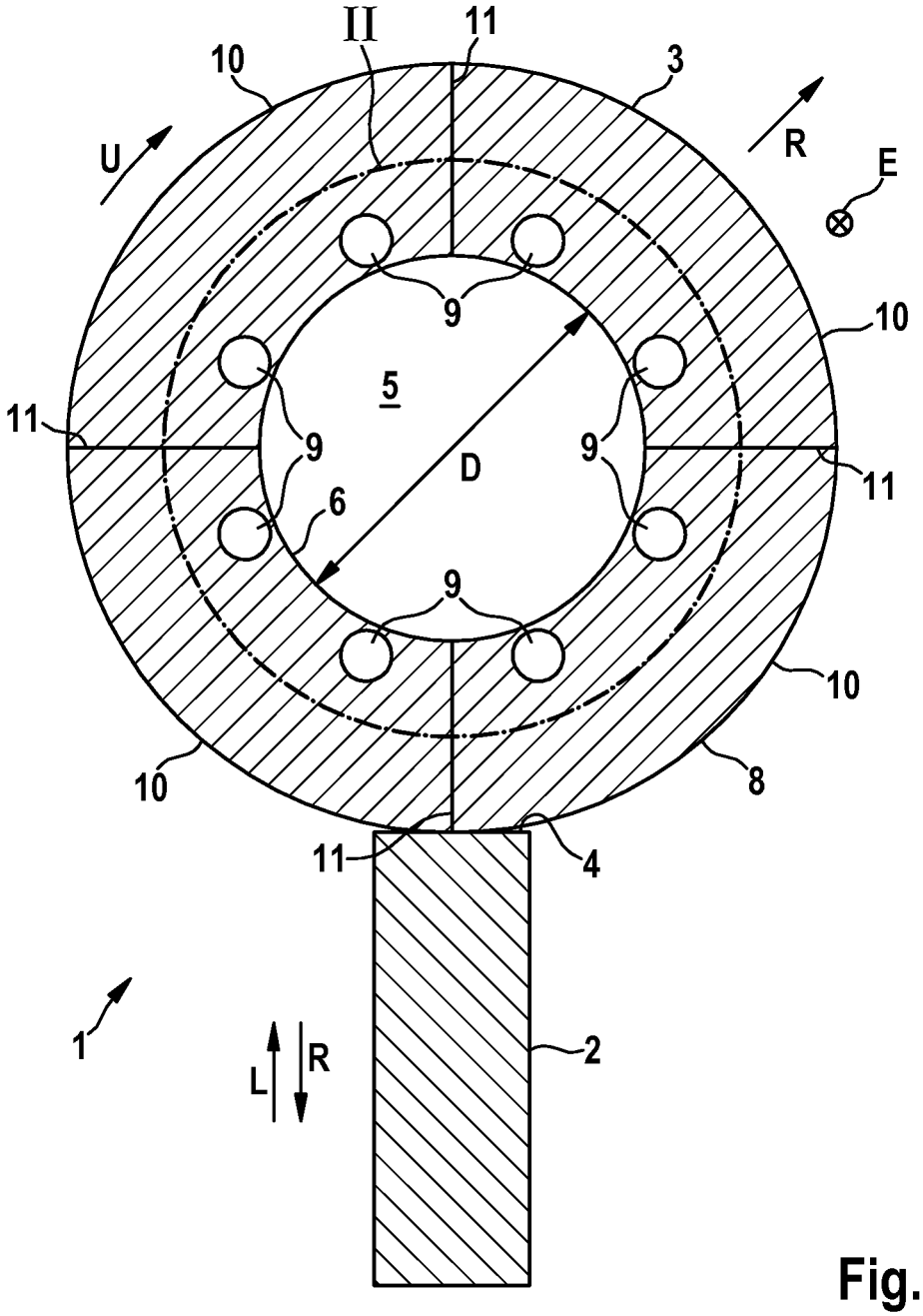
FIG. 1 shows a schematic diagram of one embodiment of a device according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawings, and in particular to FIG. 1, there is shown a device 1 with a longitudinally oscillating resonator 2 and an additional resonator 3. An ultrasound generator of the device 1 generating ultrasound oscillations, which introduces the ultrasound oscillations into the resonator 2, is not shown for sake of clarity. The ultrasound generator excites oscillations in the resonator 2, causing the resonator 2 to oscillate or vibrate back and forth along a longitudinal oscillation direction L, thereby periodically changing its length or position in the oscillation direction L.

The longitudinally oscillating resonator 2 is connected to the additional resonator 3 for transmitting ultrasound. For example, the resonator 2 abuts the additional resonator 3 with its end face 4 oriented perpendicular to the oscillation direction L, causing the end face 4 to preferably press against the additional resonator 3 so that that ultrasound oscillations can be transmitted from the longitudinally oscillating resonator 2 via its end face 4 to the additional resonator 3.

The longitudinally oscillating resonator 2 and the additional resonator 3 can be attached to each other via the end face 4 for efficient transmission of the oscillations. Alternatively, the two resonators 2, 3 may be separate from each other and may be pressed against each other solely for the purpose of transmitting the oscillations.

In the exemplary embodiment of FIG. 1, the additional resonator 3 is shown to have the shape of a ring or a torus and a continuous, centrally located opening 5. The opening 5 is preferably configured for receiving a vessel such that an inner side 6 of the additional resonator 3 facing the opening 5 abuts at least partially an outer side of a vessel wall of the vessel, enabling ultrasound oscillations to be transmitted from the additional resonator 3 to the vessel and from there to the contents of the vessel. The inner side 6 may extend parallel to a circumferential direction U and/or perpendicular to a radial direction R of the opening 5, thus surrounding the opening 5 in, for example, an arcuate shape and in particular in a circle, as shown in the exemplary embodiment of FIG. 1. The inner side 6 may be curved concave or convex in a direction E pointing into the drawing plane and perpendicular to the radial direction R and to the circumferential direction U, wherein the opening 5 extends through the additional resonator 3 in the direction E. In particular, the additional resonator 3 may have in the radial direction R a round and in particular a circular cross-section. To contact a vessel over the greatest possible area, the inner side 6 may also be at least partially straight and extend, for example, parallel to the direction E.

The end face 4 is oriented opposite the radial direction R and abuts an outer side 8 of the additional resonator 3 facing away from the opening 5. The longitudinal oscillation direction L and the radial direction R are parallel or antiparallel to each other at least in the region of the end face 4.

The oscillations are transmitted via the end face 4 to the additional resonator 3 when the resonator 2 receives ultrasound generated by the ultrasound generator and when the resonator 2 oscillates parallel to the longitudinal oscillation direction L. The additional resonator 3 converts, due to its curved and substantially circular or annular configuration, the longitudinal oscillations of the resonator 2 into radial oscillations, wherein the additional resonator 3 oscillates back and forth transversely to the circumferential direction U and parallel to the radial direction R, causing for example the diameter D of the opening 5 measured transversely to the circumferential direction U and parallel to the radial direction R to change periodically. When a vessel wall of the vessel is different from a tubular shape, the resonator 2 may have a shape different from a round or circular shape for uniform and efficient transmission of the ultrasound oscillations to the vessel or to the vessel wall.

The end face 4 may at least partially be formed complementary to the outer side 8, so that the end face 4 can abut on the outer side 8 across an area. This prevents concentrated loads on the resonators 2, 3 in the transmission of the ultrasound oscillations, so that the ultrasound oscillations are transmitted over the largest possible area.

The ultrasound oscillations cause periodic deformations of the resonators, wherein the longitudinally oscillating resonator 2 deforms periodically along the longitudinal oscillation direction L and the additional resonator 3 deforms periodically transversely to the circumferential direction U and/or parallel to the radial directions R.

In the exemplary embodiment of FIG. 1, the additional resonator 3 has eight recesses 9 to match, for example, the resonance frequency of the additional resonator 3 to a resonance frequency of the resonator 2. The recesses 9 are shown as a continuous openings arranged uniformly around the opening 5 and extending through the additional resonator 3 parallel to the direction E. The recesses 9 have a tubular shape and are surrounded by the material of the additional resonator 3 perpendicular to the direction E. The recesses 9 may be arranged along a centerline II extending in a circumferential direction U through the additional resonator 3 or may be arranged eccentrically. In the exemplary embodiment of FIG. 1, the recesses 9 are arranged closer to the inner side 6 than to the outer side 8 of the additional resonator 3, and in particular between the center line II and the inner side 6.

The additional resonator 3 may have several Lambda/2 elements 10. In the exemplary embodiment of FIG. 1, the additional resonator 3 has four Lambda/2 elements 10 of similar construction, which surround the opening 5 in a plane extending perpendicular to the direction E. In particular, the additional resonator 3 may be composed of the Lambda/2 elements 10, wherein the additional resonator 3 may be constructed of, for example, two, six, eight, ten, or twelve or more Lambda/2 elements 10.

The Lambda/2 elements are shaped as a circular arc and form in particular quadrants of the additional resonator 3. The Lambda/2 elements 10 are connected with one another at the connecting surfaces 11 for transmitting oscillations, for example welded or glued. In accordance with the exemplary embodiment of FIG. 1, two corresponding recesses 9 are each distributed uniformly along the circumferential direction U in each of the Lambda/2 elements 10.

The inner diameter D of the opening 5, for example D=28 mm, extending transversely to the direction E may substantially correspond to an outer diameter of a vessel that can be received in the opening 5. An outer diameter of the additional resonator 3 may substantially correspond to an inner diameter of a vessel, into which the additional resonator 3 is to be inserted, and may be for example 70 mm. The additional resonator 3 may have a thickness of for example 25 mm in the radial direction R. The recesses 9 may have an inner diameter of for example 10 mm transverse to the direction E. An additional resonator 3 with these dimensions may have, for example, a resonance frequency of 26 kHz. The longitudinally oscillating resonator 2 and the additional resonator 3 may together have a composite resonance frequency of for example 25.7 kHz.

The ultrasound generator of the device 1 is, for example, a piezoelectric transducer for low-frequency high-power ultrasound with an operating frequency between 15 and 100 kHz, preferably between 15 and 30 kHz and, for example, 25.7 kHz. The operating frequency of the ultrasound generator then preferably corresponds to the composite resonance frequency of the two resonators 2, 3. The acoustic power of the ultrasound transducer can be between 5 and 1000 W, preferably 15 to 300 W, and for example 150 W. An oscillation amplitude of the oscillation generated by the ultrasound generator can be, for example, 15 μm, so that the inner side 6 of the additional resonator 3 oscillates for example with 14 μm and the diameter D of the opening 5 changes by up to 28 μm per oscillation.

Figure 2:
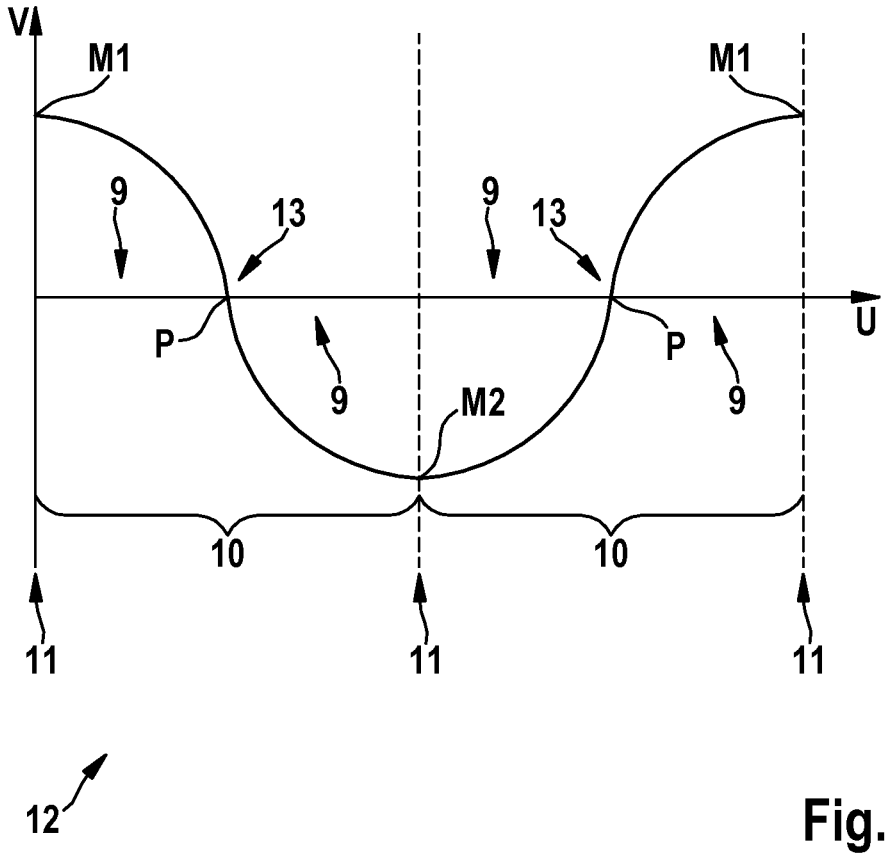
FIG. 2 shows a schematic diagram of oscillation amplitudes.

FIG. 2 shows in a diagram 12 waveforms of two Lambda/2 elements 10. In particular, the oscillation of the additional resonator 3 is illustrated along the center line II, showing the oscillation of two Lambda/2 elements 10 interconnected via one of the connecting surfaces 11. A length of the two Lambda/2 elements 10 along the circumferential direction U and the center line II is shown on an abscissa of the diagram 12. The two Lambda/2 elements 10 extend along the circumferential direction U. The size of the deformation V of the Lambda/2 elements 10 is depicted on the ordinate of the graph 12. The diagram 12 shows a snapshot wherein the connecting surfaces 11 are maximally deflected. Conversely, a section 13 of Lambda/2 elements 10 disposed intermediate between the connecting surfaces is not deflected. The deformation of the two Lambda/2 elements 10 is substantially sinusoidal. The recesses 9 are each arranged between oscillation extremes M1, M2 and an inflection point P of the oscillation of the respective Lambda/2 element located in section 13. The Lambda/2 elements 10 of the additional resonator 3 oscillate in the exemplary embodiment of FIG. 1 as a standing wave.

Figure 4:
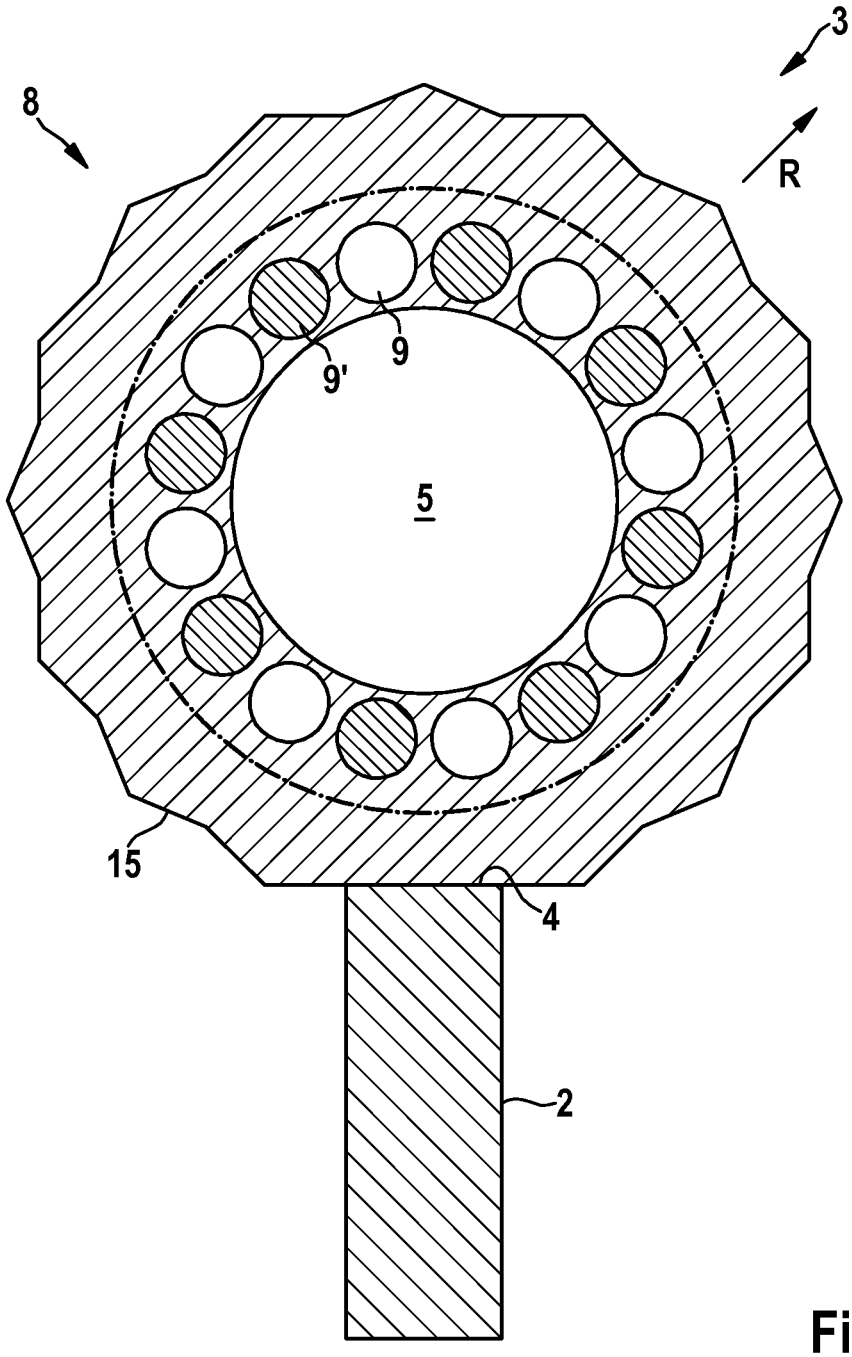
Figure 5:
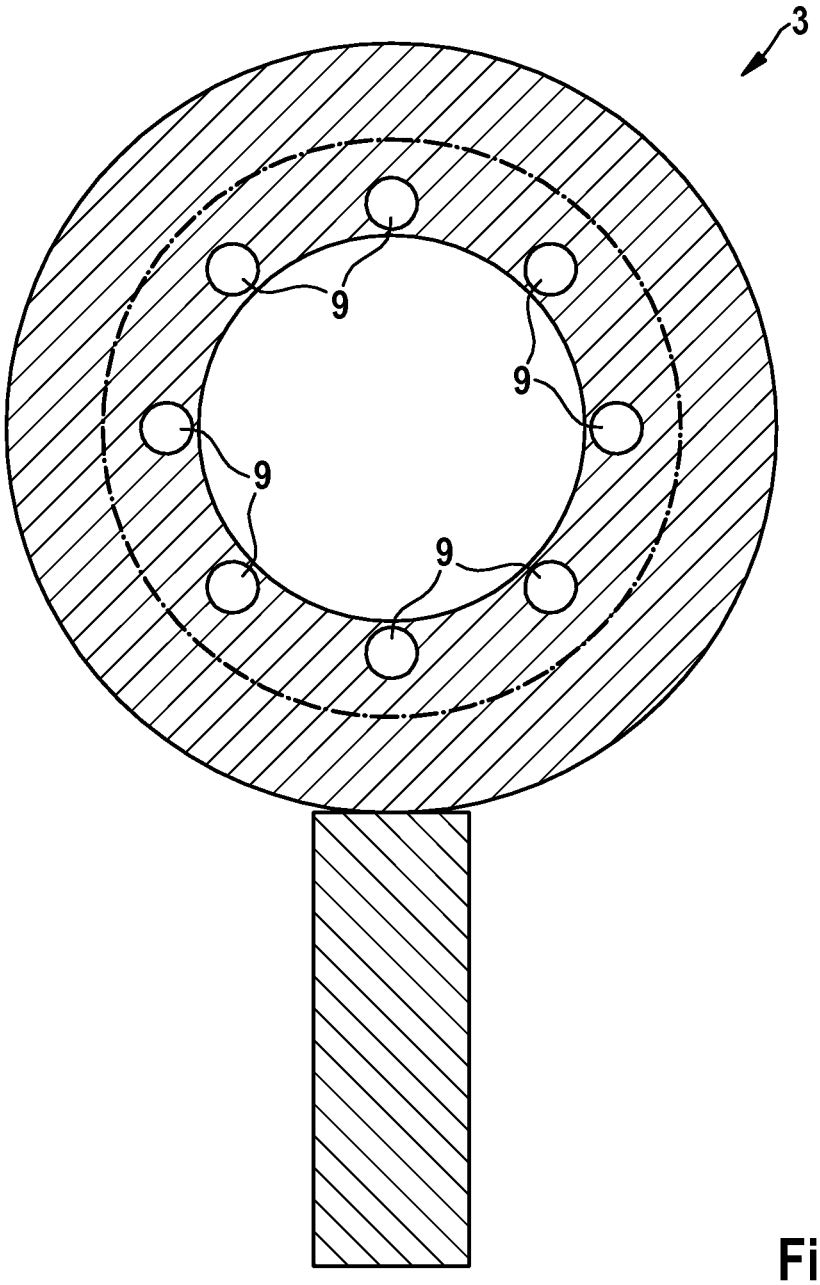
Figure 6:
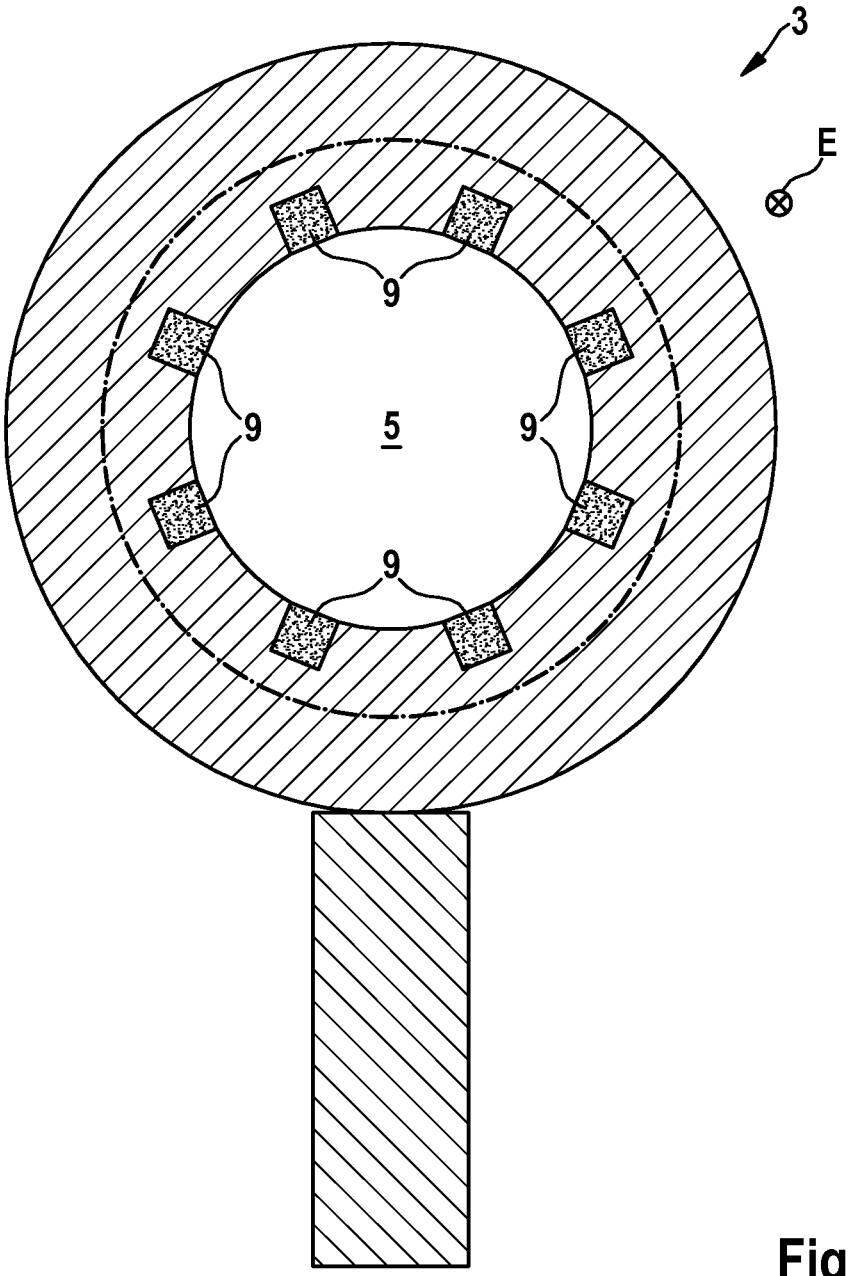

FIGS. 4 to 6 show additional exemplary embodiments of the additional resonator 3 of the invention, wherein the same reference symbols are used for elements that correspond in function and/or structure to the elements of the exemplary embodiment of FIG. 1.

Figure 3:
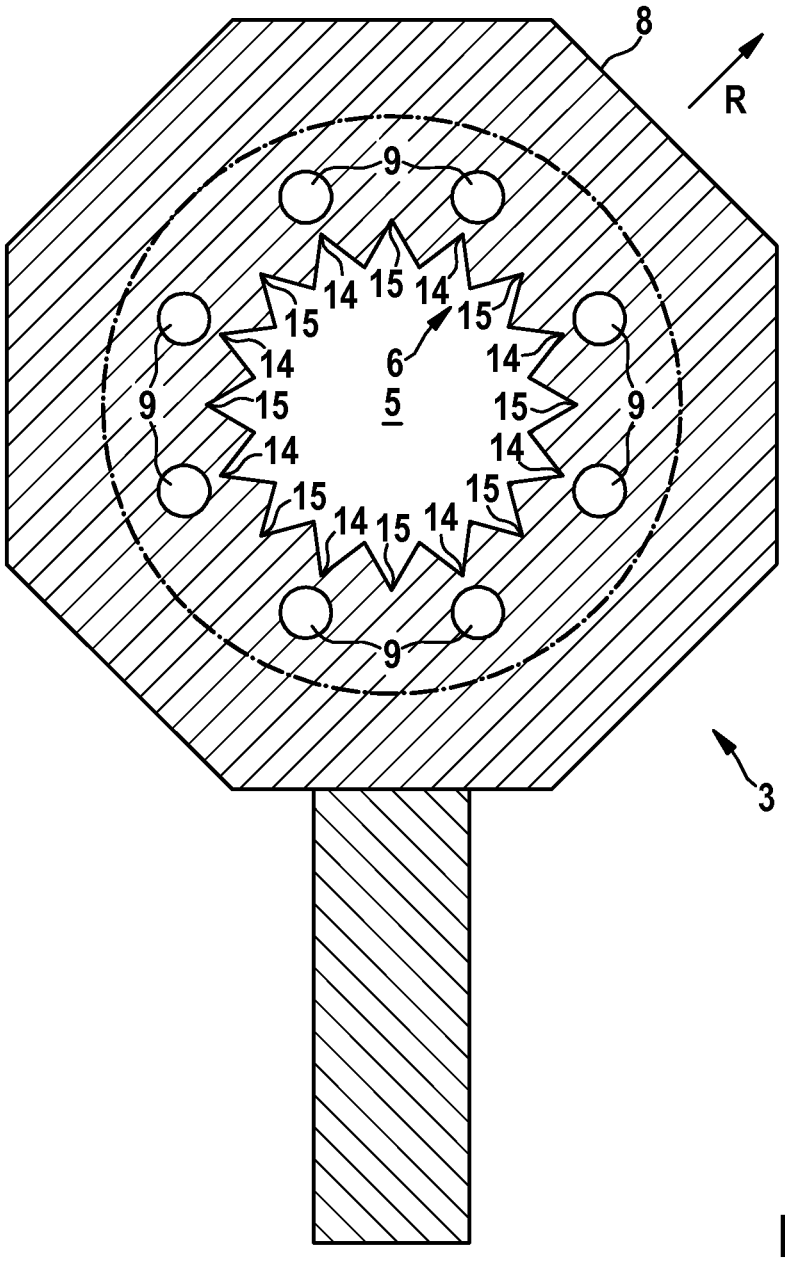
FIGS. 3-6 show schematic diagrams of additional embodiments of the device according to the present invention.

In the embodiment of FIG. 3, the inner side 6 has a jagged shape and surrounds the central opening 5 and the shape of a star. The outer side 8 surrounds the additional resonator 3 in the shape of a uniform octagon.

Every second tip 14 of the jagged inner side 6 that recedes from the central opening 5 in the radial direction R points towards one of the eight recesses 9. Between the recesses 9, the teeth 15 arranged between the tips 14 and oriented in the radial direction R point away from the opening 5.

The additional resonator 3 of the exemplary embodiment of FIG. 4 has sixteen recesses 9, wherein each second recess 9' is formed not as a continuous tube, but instead as a blind hole. Furthermore, the additional resonator 3 of the exemplary embodiment of FIG. 4 has 16 Lambda/2 elements, wherein each of the Lambda/2 elements has one of the recesses 9, 9'. The outer side 8 is jagged and includes fifteen protruding teeth 15, wherein the teeth 15 are arranged so as to face away from the opening 5. In order to improve contact with the end face 4 of the resonator 2, a sixteenth tooth 15 is omitted, so that the additional resonator 3 rests flat against the flat end face 4.

The additional resonator 3 of the exemplary embodiment shown in the FIG. 5 corresponds substantially to the additional resonator 3 of the exemplary embodiment of FIG. 1, wherein in accordance with the exemplary embodiment of FIG. 5 the recesses 9 are each arranged at the oscillation maxima or oscillation minima of the Lambda/2 elements 10.

In the exemplary embodiment of FIG. 6, the recesses 9 open towards the opening 5, wherein the recesses 9 are formed here as blind holes that open against the direction E and have a rectangular or square cross section.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A device for generating ultrasound oscillations, comprising:

an ultrasound generator, a resonator connected to the ultrasound generator for conducting ultrasound and oscillating longitudinally during operation of the ultrasound generator, and an additional resonator connected to the longitudinally oscillating resonator in an ultrasound transmitting manner and oscillating radially in a plurality of radial directions during the operation of the ultrasound generator, such that the longitudinal oscillations are converted to radial oscillations.

2. The device of claim 1, wherein the additional resonator has an opening and extends around the opening at least sectionally.

3. The device of claim 1, wherein the additional resonator is substantially ring-shaped.

4. The device of claim 1, wherein the additional resonator comprises a plurality of Lambda/2 elements arranged along its circumferential direction.

5. The device of claim 4, wherein the additional resonator comprises an even number of Lambda/2 elements.

6. The device of claim 4, wherein the additional resonator has an opening and extends at least sectionally around the opening, the opening being at least sectionally surrounded by the plurality of Lambda/2 elements in a plane.

7. The device of claim 2, wherein the opening is delimited by an inner side of the additional resonator, said inner side having a shape selected from an arc, a circle, a curve, a round, a jagged shape, a polygonal shape and a star shape.

8. The device of claim 1, wherein an outer side of the additional resonator has a shape selected from an arc, a circle, a curve, a round, a jagged shape, a polygonal shape and a star shape.

9. The device of claim 1, wherein the additional resonator comprises at least one recess.

10. The device of claim 4, wherein at least one of the plurality of Lambda/2 elements comprises at least one recess.

11. The device of claim 9, wherein the at least one recess is configured to change a resonance frequency of the additional resonator.

12. The device of claim 1, wherein the additional resonator's resonant frequency matches the resonant frequency of the longitudinally oscillating resonator.

13. The device of claim 1, wherein the additional resonator completely surrounds an opening in the center of the device.

* * * * *